US008783678B2

(12) United States Patent
Sunohara

(10) Patent No.: US 8,783,678 B2
(45) Date of Patent: Jul. 22, 2014

(54) SHEET STORAGE CASSETTE AND IMAGE FORMING APPARATUS

(71) Applicant: Oki Data Corporation, Tokyo (JP)

(72) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/929,886

(22) Filed: Jun. 28, 2013

(65) Prior Publication Data

US 2013/0285310 A1 Oct. 31, 2013

Related U.S. Application Data

(62) Division of application No. 13/485,890, filed on May 31, 2012, now abandoned.

(30) Foreign Application Priority Data

Jun. 3, 2011 (JP) ..... 2011-125237

(51) Int. Cl.
*B65H 1/00* (2006.01)
*B65H 1/26* (2006.01)

(52) U.S. Cl.
CPC ..... *B65H 1/00* (2013.01); *B65H 2801/06* (2013.01); *B65H 2551/23* (2013.01); *B65H 2405/112* (2013.01); *B65H 2405/114* (2013.01); *B65H 1/266* (2013.01)
USPC ..... 271/171

(58) Field of Classification Search
CPC ..... B65H 1/04; B65H 2511/10; B65H 1/266; B65H 2511/12
USPC ..... 271/145, 171, 240
See application file for complete search history.

(56) References Cited

U.S. PATENT DOCUMENTS

| | | | | |
|---|---|---|---|---|
| 5,815,787 | A * | 9/1998 | Crayton et al. | 399/393 |
| 7,862,035 | B2 * | 1/2011 | Shiohara et al. | 271/167 |
| 2004/0188924 | A1 | 9/2004 | Ito | |
| 2009/0072471 | A1 | 3/2009 | Rowe et al. | |
| 2009/0206544 | A1 * | 8/2009 | Allwright | 271/145 |
| 2009/0206545 | A1 | 8/2009 | Sunohara | |
| 2010/0314821 | A1 * | 12/2010 | Ohno | 271/3.02 |
| 2011/0291349 | A1 * | 12/2011 | Nemura et al. | 271/145 |
| 2013/0001867 | A1 * | 1/2013 | Akatsuka | 271/171 |
| 2013/0161898 | A1 * | 6/2013 | Lee | 271/145 |

FOREIGN PATENT DOCUMENTS

| | | | | |
|---|---|---|---|---|
| JP | 58052130 | | 3/1983 | |
| JP | 61140464 | | 6/1986 | |
| JP | 04007217 | | 1/1992 | |
| JP | 04023778 | | 1/1992 | |
| JP | 05024710 | | 2/1993 | |
| JP | 05294471 | A * | 11/1993 | B65H 1/26 |
| JP | 2005-075610 | A | 3/2005 | |

* cited by examiner

*Primary Examiner* — Prasad Gokhale
(74) *Attorney, Agent, or Firm* — Rabin & Berdo, P.C.

(57) ABSTRACT

A sheet storage cassette can include a sheet supporting board and a restriction guide. The sheet supporting board can support at least one sheet thereon. The restriction guide can be arranged on the sheet supporting board and include a sheet holding surface that is substantially perpendicular to the sheet support board. The restriction guide can further include a mark indicated part at an upper side thereof, where the mark indicated part can extend at least partly along a plane that intersects a plane of the holding surface and can indicate a maximum storage capacity level of the sheet storage cassette.

4 Claims, 12 Drawing Sheets

SHEET STORAGE CASSETTE AND IMAGE FORMING APPARATUS

CROSS-REFERENCE TO RELATED APPLICATION

This application is a divisional of application Ser. No. 13/485,890, filed on May 31, 2012. Furthermore, this application claims the benefit of priority of Japanese application 2011-125237, filed Jun. 3, 2011. The disclosures of these prior U.S. and Japanese applications are incorporated herein by reference.

BACKGROUND

1. Technical Field

This application relates to a sheet storage cassette and an image forming apparatus that includes the sheet cassette.

2. Description of the Related Art

An image forming apparatus, such as an electro-photographic printer, a fax machine, and a copying machine, includes a sheet storage cassette that stores sheets. A sheet supplying unit of the printer separates and supplies individual sheets stored in the sheet cassette into an image forming unit. Then a process of an image forming onto the sheet is executed in the image forming unit. During use of the printer, if all stored sheets are supplied into the image forming apparatus, an operator of the image forming apparatus supplies a deficiency of sheets. Also, a mark that indicates maximum storage capacity level of the sheet storage cassette is arranged on a sheet width restriction guide disposed on the sheet storage cassette that is perpendicular to the under floor of the sheet storage cassette.

SUMMARY

This application relates to a sheet storage cassette including a mark that indicates a maximum storage capacity level of the sheet storage cassette so that an operator of an image forming apparatus can confirm (e.g., determine or refer to) the maximum storage capacity easily.

According to one aspect, a sheet storage cassette can include a sheet supporting board and a restriction guide. The sheet supporting board can support at least one sheet thereon. The restriction guide can be arranged on the sheet supporting board and include a sheet holding surface that is substantially perpendicular to the sheet supporting board. Also, the restriction guide can include a mark indicated part at an upper side thereof, where the mark indicated part can extend at least partly along a plane that intersects a plane of the sheet holding surface and can indicate the maximum sheet capacity level of the sheet storage cassette.

BRIEF DESCRIPTION OF THE DRAWINGS

The sheet storage cassette and the image forming apparatus will be more fully understood from the following detailed description with reference to the accompanying drawings, which are given by way of illustration only, and are not intended to be limiting, wherein.

DETAILED DESCRIPTION

First Embodiment

Figure 2:
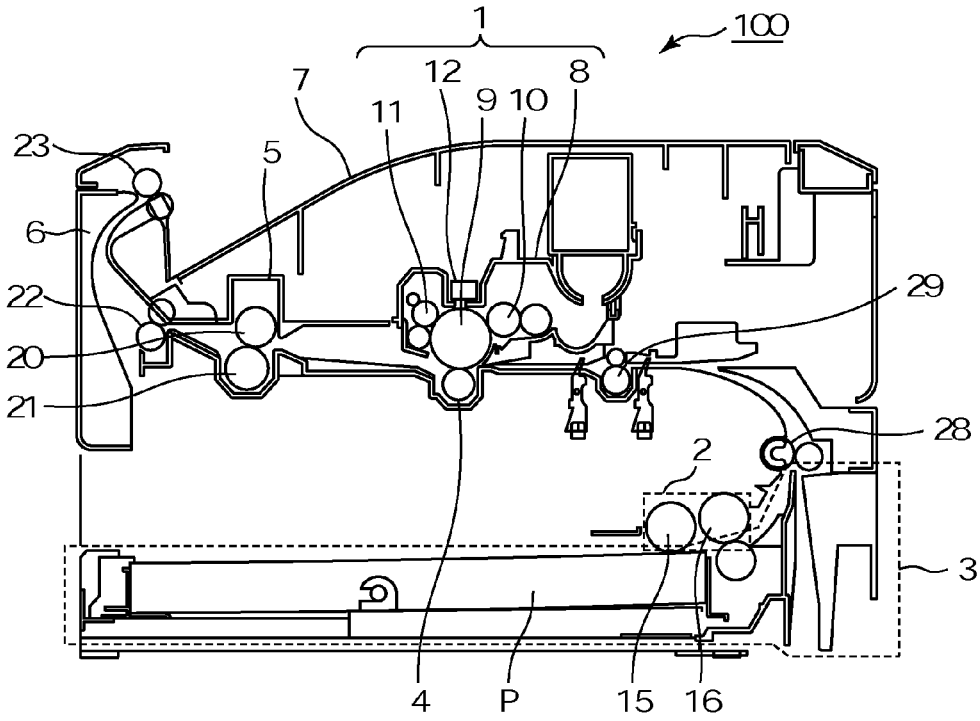
FIG. 2 is an explanatory view illustrating a composition of a printer according to the first embodiment.

FIG. 2 is an explanatory view illustrating a composition of a printer 100 according to a first embodiment. The printer 100 can serve as an image forming apparatus, by creating an image on a sheet P (e.g., of paper or other material suitable for receiving an image) with an electro-photographic technique, based on image data received from an external computer. The printer 100 can include an image forming unit 1, a sheet supplying unit 2, a sheet storage cassette 3, a transfer roller 4, a fusing unit 5, an ejecting unit 6, and a sheet stacker member 7.

The image forming unit 1 can include an image drum cartridge 8 and an optical unit 12. The sheet supplying unit 2 can include a pick-up roller 15 and a sheet supplying roller 16, and can separate and supply individual sheets P stored in the sheet storage cassette 3 to an image forming unit 1. Also, a carrying roller 28 and a carrying roller 29 can be arranged downstream of the sheet supplying unit 2 in a sheet carrying direction, and the carrying rollers 28 and 29 can carry the sheet P into the image forming unit 1.

The transfer roller 4 can transfer an image formed by the image forming unit 1 onto the sheet P. The fusing unit 5 can include a heating roller 20 that is controlled so as to maintain the temperature of the heating roller 20 within a predefined temperature range, and a pressure roller 21. Also, the fusing unit 5 can fuse the transferred image onto the sheet P by heating of the heating roller 20 and pressing of the pressure roller 21. The ejecting unit 6 can include an ejecting roller 22 and an ejecting roller 23 that carry the sheet P having the image fused thereon so as to eject the sheet P. The sheet stacker 7 can be arranged on an upper side of the printer 100, and the sheet P ejected from the ejecting unit 6 can be stored on the sheet stacker 7.

The image drum cartridge 8 can include an image drum 9 serving as an image carrier, a developing unit 10, and a charging unit 11. A toner image can be formed on the image drum 9. The optical unit 12 can be arranged upon the image drum 9, and include an LED head that has LED elements arranged in the direction of the axis of the image drum 9. Also, the optical unit 12 can expose the image drum 9 based on the image data received from the external computer. In addition, a laser scanning unit that includes a laser irradiation part and a polygon mirror may be used as the optical unit 12.

Figure 3:
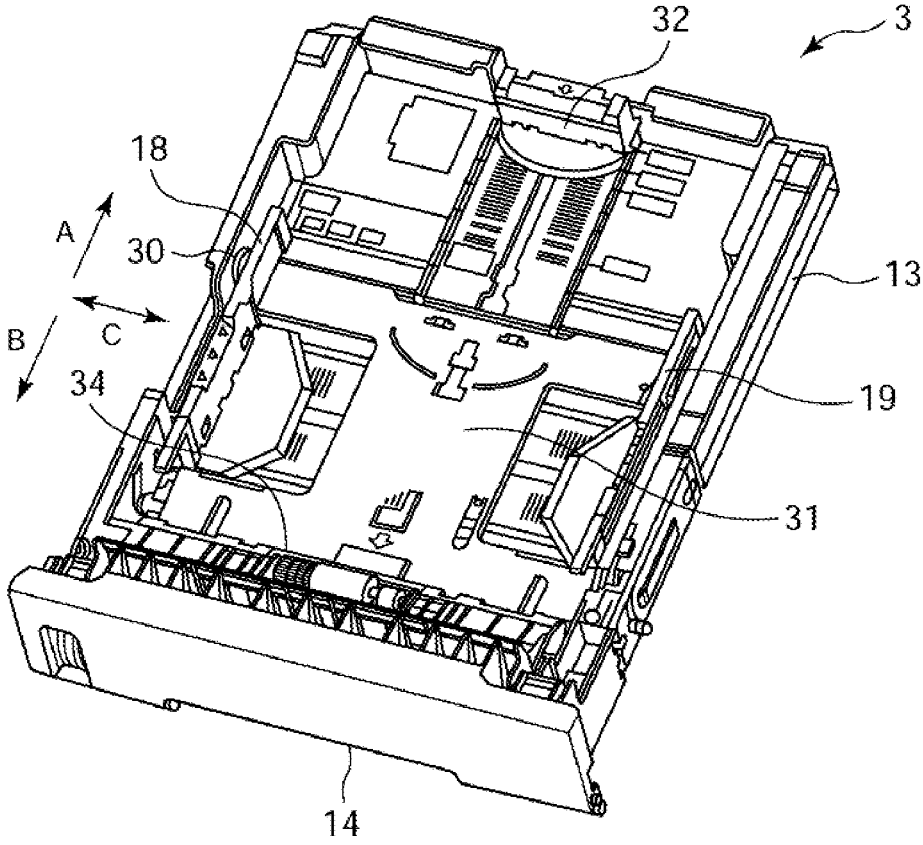
FIG. 3 is a perspective view of the sheet storage cassette according to the first embodiment.

FIG. 3 is a perspective view of the sheet storage cassette 3. The sheet storage cassette 3 can be supported in an under part of the printer 100 so as to be able to move into and from the under part. Also, the sheet storage cassette 3 can include guide members 13 arranged laterally, e.g., on sides of the sheet storage cassette 3. When the sheet storage cassette 3 is inserted into the under part of the printer 100, the sheet storage cassette 3 can slide in the A direction shown in FIG. 3, e.g., a direction toward a back of the sheet storage cassette 3, after the guide 13 engages with a rail (not illustrated) arranged inside the printer 100. Also, the sheet storage cassette 3 can include a cover 14 at the front face thereof that is a part of a housing of the under front face of the printer 100. Also, the sheet storage cassette 3 can form a box-like structure including one or more flat surfaces, that has an opening portion at an upper side thereof, and the sheet P can be inserted into the sheet storage cassette 3 through the opening portion. If all stored sheets P are used up, the operator can restock the sheet storage cassette 3 with more sheets P at the opening portion.

Figure 1:
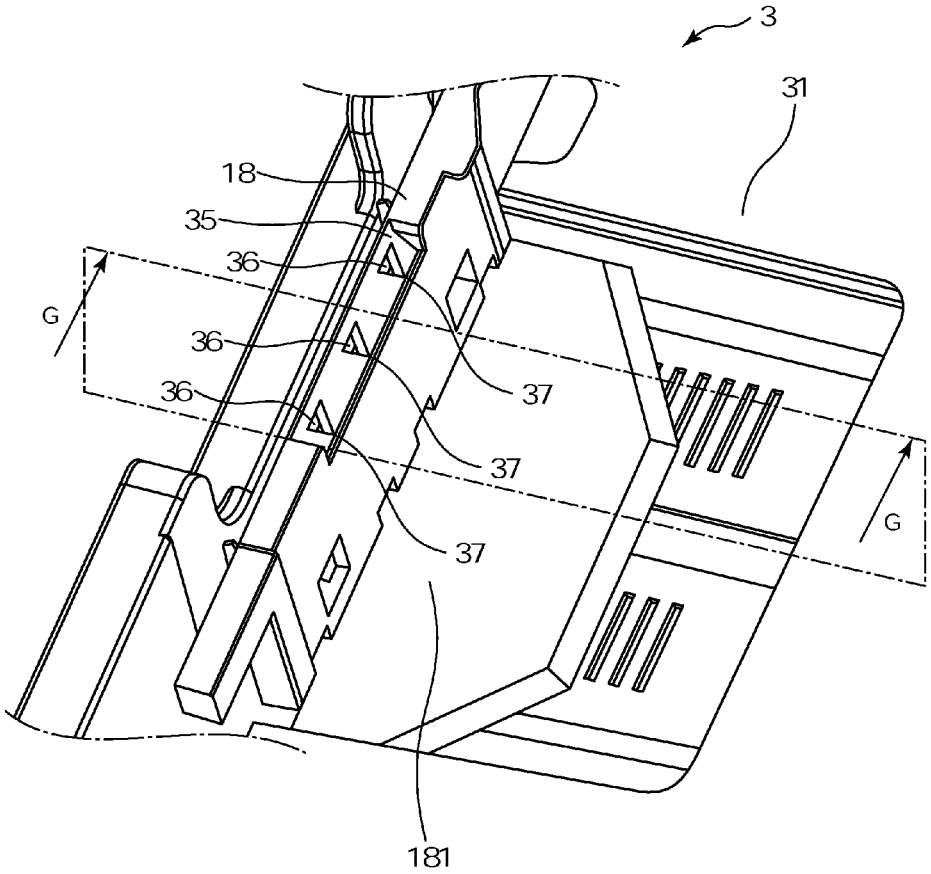
FIG. 1 is an enlarged view illustrating an area around a restriction guide of a sheet storage cassette according to a first embodiment of the sheet storage cassette.

Referring to FIG. 1, the rollers 15 and 16 can be disposed at the front upper side of the sheet storage cassette 3 when the sheet storage cassette 3 is inserted into the under part of the printer 100. The pick-up roller 15 can separate and supply individual sheets P to the sheet supplying roller 16. The sheet supplying roller 16 can supply a sheet P received from the pick-up roller 15 to the image forming unit 1. In this way, the sheet P can be supplied in the B direction shown FIG. 3, e.g., toward a front of the sheet storage cassette 3.

Also, the sheet storage cassette 3 can include a left restriction guide 18, a right restriction guide 19, a sheet supporting board 31, and a back end guide 32. The left and right restriction guides 18 and 19 can move in the C direction in shown FIG. 3, e.g., in a direction along a width of the sheet P. Also, the restriction guides 18 and 19 can approach and separate from each other. Therefore, the sheet storage cassette 3 can support various kinds of sheets that have respectively different sizes. The restriction guides 18 and 19 can restrict movement of the sheet P in a perpendicular direction with respect to a sheet carrying direction, e.g., can support left and right ends of the sheet P.

The back end guide 32 can be disposed at a back side of the sheet storage cassette 3, and can restrict movement of the sheet P in the A direction, e.g., can support a back end of the sheet P. Also, the sheet storage cassette 3 can include a front end stopper 34 at a front side so as to restrict movement of the sheet P in the B direction, e.g., can support the front end of the sheet P. The sheet supporting board 31 can rotate around a rotational shaft 30 that has a rotational axis parallel to the C direction so as to press the front end of the sheet P supported thereon toward the rollers 15 and 16. Therefore, the rollers 15 and 16 can separate and supply the individual sheets P to the image forming unit 1.

Figure 4:
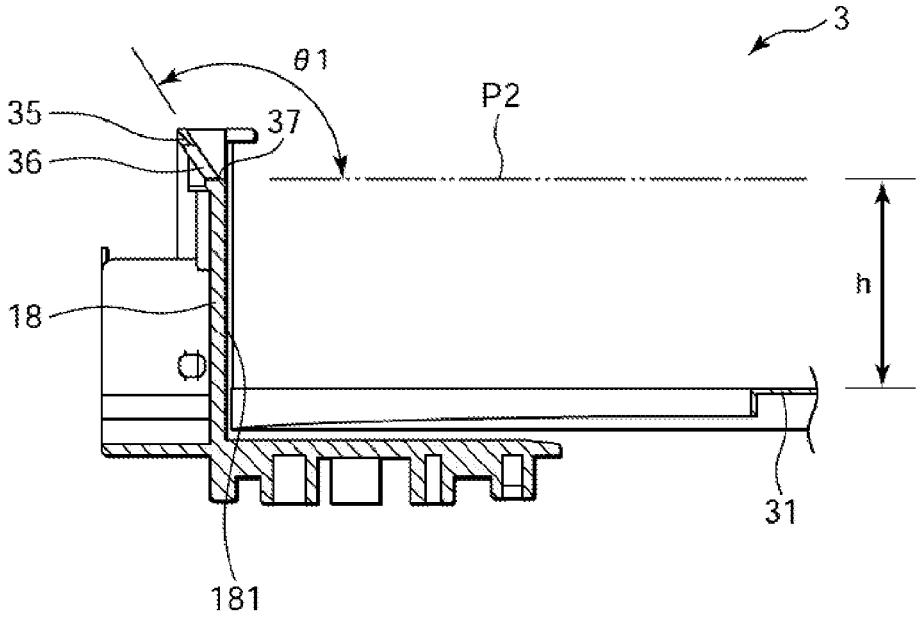
FIG. 4 is an explanatory view illustrating a cross section of the sheet storage cassette along a plane G-G in FIG. 1 according to the first embodiment.
Figure 6:
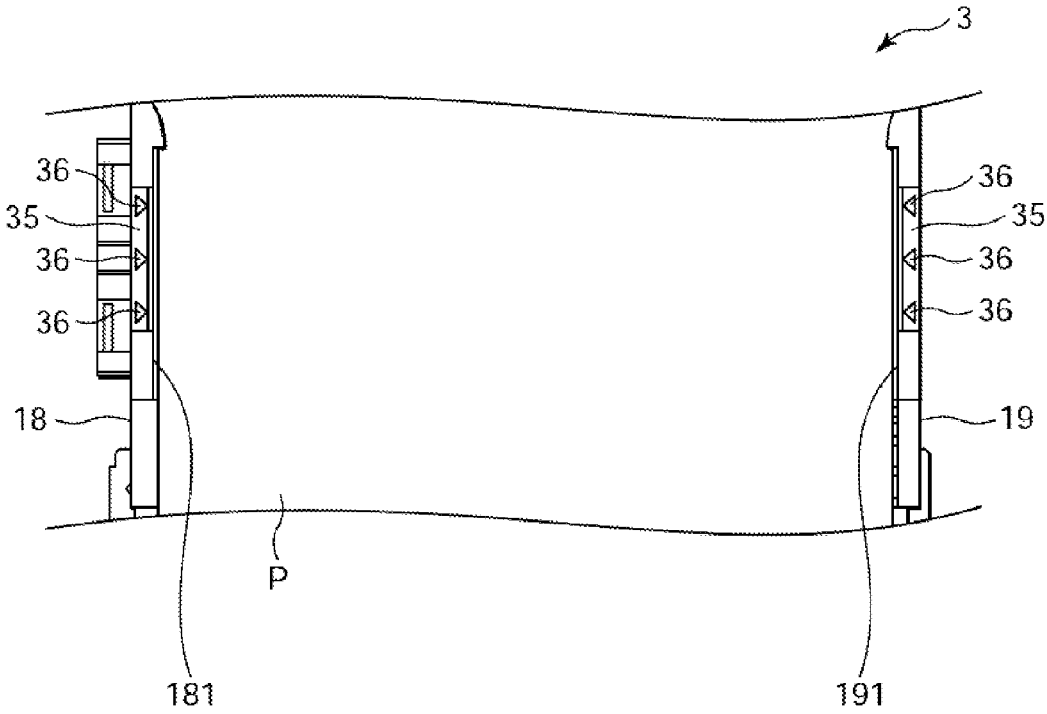
FIG. 6 is an explanatory plan view illustrating the sheet storage cassette in a state corresponding to the maximum storage capacity load according to the first embodiment.

FIG. 1 is an enlarged view illustrating an area around the left restriction guide 18 of the sheet storage cassette 3. FIG. 4 is an explanatory view illustrating a cross section of the sheet storage cassette 3 along a plane G-G in FIG. 3. As illustrated, an inclined part 35 can be arranged at an upper side of the left restriction guide 18. Also, as shown in FIG. 6 that will be described later, the inclined part 35 can be arranged at upper sides of the right restriction guide 19. The inclined part 35 can be planate, e.g., a planar part, and serve as a mark indicated part extending along the width direction of the sheet P. Also, restriction faces 181 and 191 can be disposed laterally, e.g., on sides of the left and right restriction guides 18 and 19 so as to each face a side of a stored sheet P (shown in FIG. 6). The restriction faces 181 and 191 can act as sheet holding surfaces, extending in a substantially perpendicular direction with respect to the sheet supporting board 31, and holding (e.g., restricting or retaining) sheets P along sides of the sheets P. The inclined part 35 can include a plate-like member, and be fixed on the respective restriction guides 18 and 19 so as to collectively form a single member. Also, the inclined part 35 can include a mark 36 that indicates a maximum capacity level of sheets P in the sheet storage cassette 3. The mark 36 can be or include, for example, an inverted triangular hole formed on the inclined part 35. An under top edge part 37 disposed at an underside of the mark 36 can indicate a boundary position of the maximum capacity level of the sheets P.

A height from the sheet supporting board 31 to the under top edge part 37 can be a maximum storing height h of the sheets P. The under top edge part 37 can be disposed on the respective restriction guides 18 and 19 and be disposed at the same maximum storing height h. If the printer 100 is used in the state of the sheet storage cassette 3 storing the sheets P so that the height of sheets P exceeds the height h, jamming of the sheets as they are carried, and breakage or tearing of the sheets might occur because of an inappropriate sheet supplying of the rollers 15 and 16.

An angle between the inclined part 35 and an upper surface of a sheet P stored at the maximum capacity level, e.g., a fictive upper surface P2 that has the same height of the under top edge part 37, can be θ1. Here, the angle between the inclined part 35 and the upper surface of the sheet P is the same or substantially the same as an angle between the inclined part 35 and an upper surface of the sheet supporting board 31, and can be θ1. The angle θ1 can be a blunt or obtuse angle, for example. For example, the angle θ1 can range between 110° and 150° inclusive of 110° and 150°. As a result, the operator can confirm, e.g., use the mark 36 as a reference, by a visual inspection.

In describing the first embodiment, the mark 36 has been described as having, as one possibility, the form of an inverted triangular hole formed on the inclined part 35. However, the mark 36 is not limited to this form. Additionally or alternatively, for example, a graphic formed on the inclined part 35 can be used as the mark 36.

Next, a behavior of the printer 100 will be described. Individual sheets P stored in or on the sheet storage cassette 3 can be separated by the pick-up roller 15, and be supplied downstream of the sheet carrying direction by the supplying roller 28. Also, an individual sheet P can be carried to a pressing part between the image drum 9 and the transfer roller 4 by the carrying rollers 28 and 29, and the toner image formed on the image drum 9 can be transferred onto the individual sheet P. Then the toner on the individual sheet P that is not fused can be fused onto the individual sheet P by the rollers 20 and 21. After fusing, the individual sheet P can be ejected to the sheet stacker 7 by the rollers 22 and 23 so that the surface of the individual sheet P on which the image is formed faces toward the sheet stacker 7. At this point, the process of forming the image on the individual sheet P may be considered to be complete, although alternatives are possible.

Figure 5:
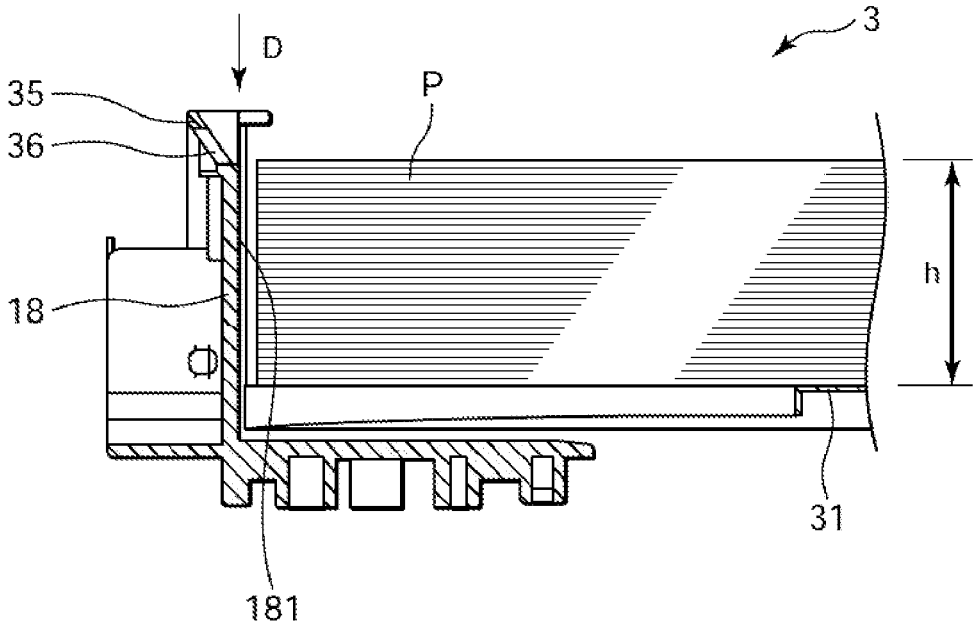
FIG. 5 is an explanatory cross-sectional view illustrating the sheet storage cassette loaded to a maximum storage capacity level according to the first embodiment.

FIG. 5 is an explanatory view illustrating a cross section of the sheet storage cassette 3 loaded to a maximum storage capacity level. FIG. 6 is an explanatory plan view illustrating the sheet storage cassette 3 in a state corresponding to the maximum storage capacity load. If the sheets P are stored in or on the sheet storage cassette 3, the restriction guides 18 and 19 can restrict movement of the sheets P along the width direction of the sheets P, and the front end stopper 34 and the back end guide 32 can restrict movement of the sheets P in the carrying direction of the sheets P. If the operator sets, e.g., loads or stacks, the sheets P up to the maximum capacity level on the sheet supporting board 31, the operator can load the sheets P based on the mark 36 arranged on the left restriction guide 18 or the right restriction guide 19 so that the height of the sheets P reaches to the maximum storing height h. As shown in FIG. 6, even if the sheets P are stored in or on the sheet storage cassette 3 up to the maximum capacity level, the operator can confirm (e.g., see or refer to) the marks 36 from the upper side of the sheet storage cassette 3 (in the D direction as shown FIG. 5).

Figure 7:
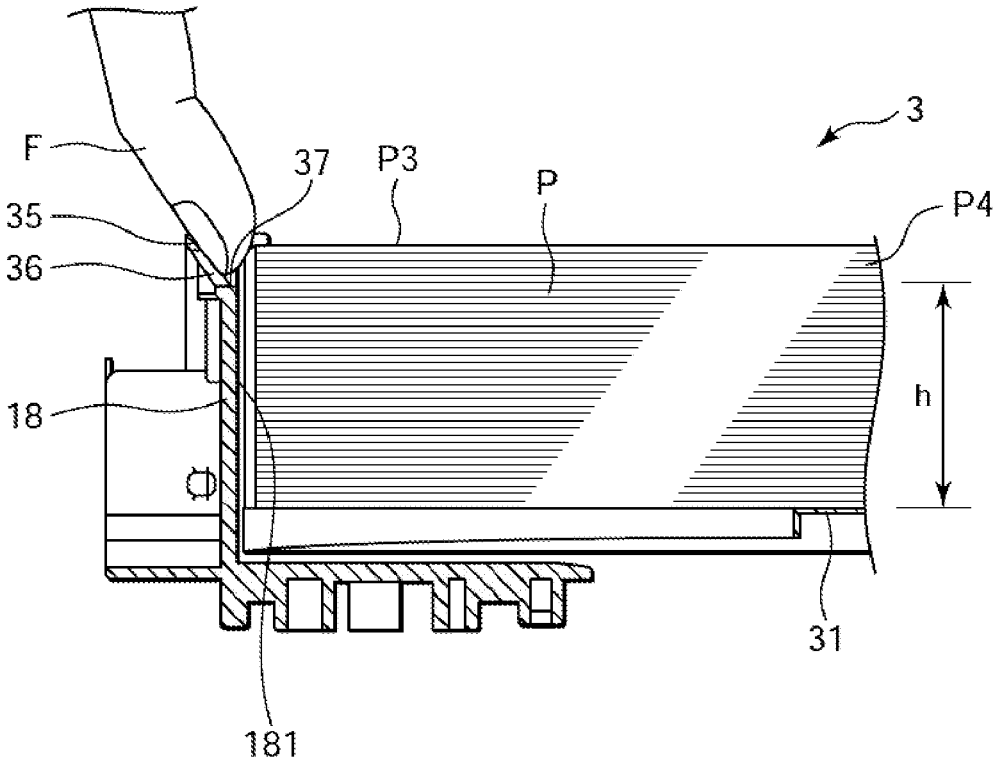
FIG. 7 is an explanatory cross-sectional view illustrating the sheet storage cassette loaded beyond the maximum storage capacity level according to the first embodiment.

FIG. 7 is an explanatory cross-sectional view illustrating the sheet storage cassette 3 loaded beyond the maximum storage capacity level. The operator can confirm (e.g., determine) a difference in height between the under top edge part 37 and a highest sheet P3 in the sheets P by a visual inspection. Also, the operator can insert, e.g., a finger F into a clearance gap between the inclined part 35 and the sheets P, and can confirm tactually whether or not the sheet P3 is higher than the under top edge 37.

If the sheet P3 is higher than the under top edge 37, the operator can easily remove excess sheets P4, where the excess sheets P4 can correspond to a portion of the sheets P that extend beyond the maximum storing height h. The operator can remove the excess sheets P4, for example, by inserting the finger F into the clearance gap between the inclined part 35 and the sheets P.

As described above, in the first embodiment, the inclined part 35 that is a planar part can be arranged on the left restriction guide 18 and the right restriction guide 19, and the mark 36 that indicates the maximum storing capacity level of the sheet P can be arranged on the inclined part 35 so that the operator can confirm (e.g., see or refer to) the mark 36 from the upper side of the sheet storage cassette 3. As a result, the operator can confirm the mark 36 even if the sheets P are stored in or on the sheet storage cassette 3, and can accurately set (e.g., load or stack) the sheets P to the level of the maximum storing capacity height h. Additionally, since the inclined part 35 that is planate can be arranged on the left and right restriction guides 18 and 19 so as to extend along the width direction of the sheet P, the operator can confirm the difference in height between the under top edge part 37 and a highest sheet P3, and can easily remove sheets P4 that exceed the maximum storing height h. The operator can remove the excess sheets P4, for example, by inserting the finger F into the clearance gap between the inclined part 35 and the sheet P.

Second Embodiment

Figure 8:
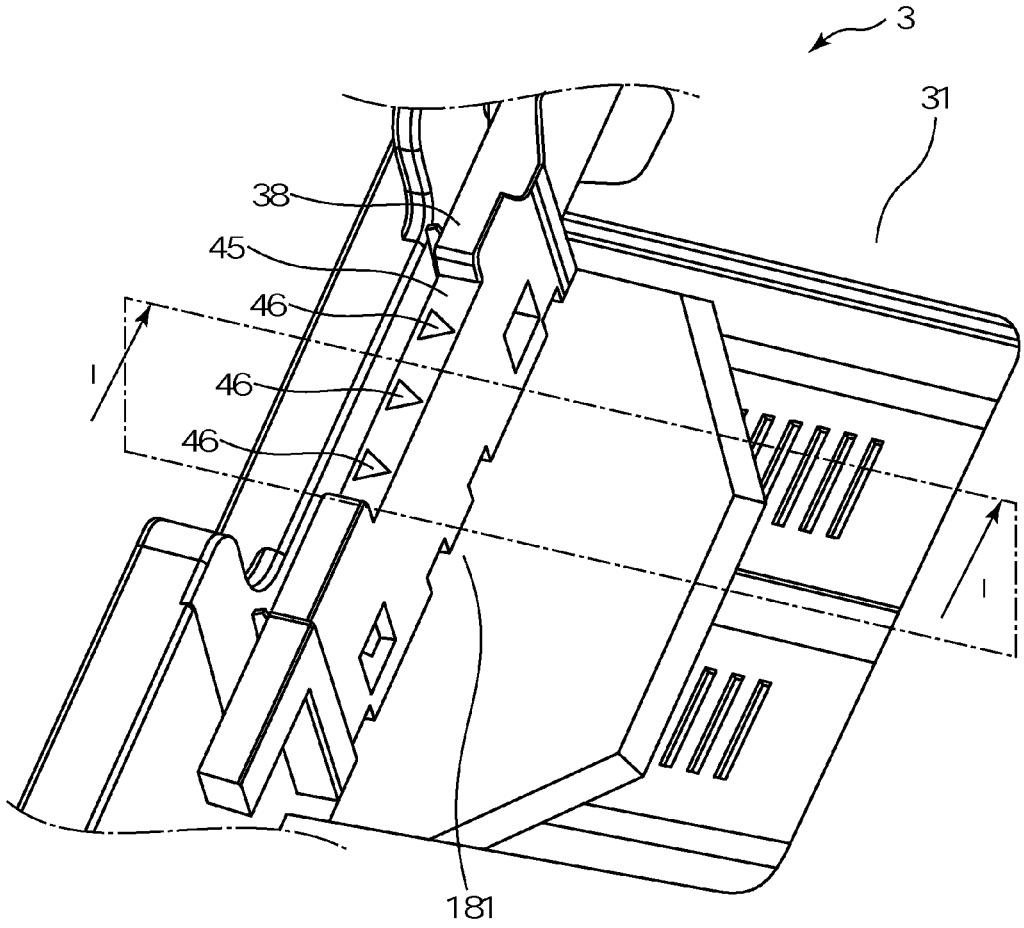
FIG. 8 is an enlarged view illustrating an area around a restriction guide of a sheet storage cassette according to a second embodiment of the sheet storage cassette.
Figure 9:
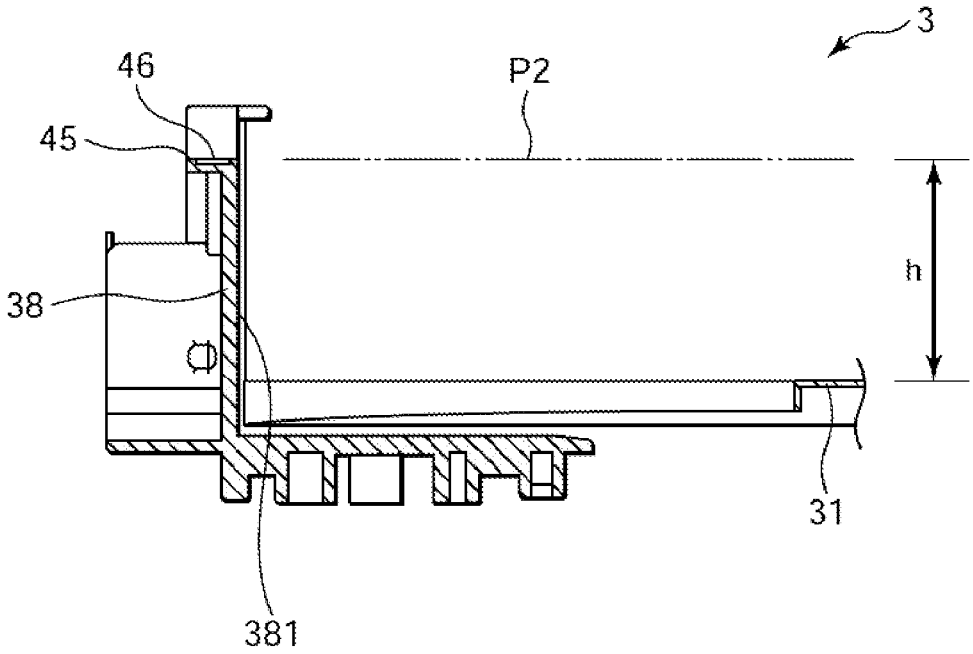
FIG. 9 is an explanatory view illustrating a cross section of the sheet storage cassette along a plane I-I in FIG. 8 according to the second embodiment.

Next, a composition of the sheet storage cassette 3 of a second embodiment will be described. Elements identical to those of the first embodiment will be designated by the same reference numbers, and results based on inclusion of the identical elements will be incorporated herein by reference. FIG. 8 is an enlarged view illustrating an area around a left restriction guide 38 according to the second embodiment. FIG. 9 is an explanatory view illustrating a cross section of the sheet storage cassette 3 along a plane I-I in FIG. 8 according to the second embodiment.

Figure 11:
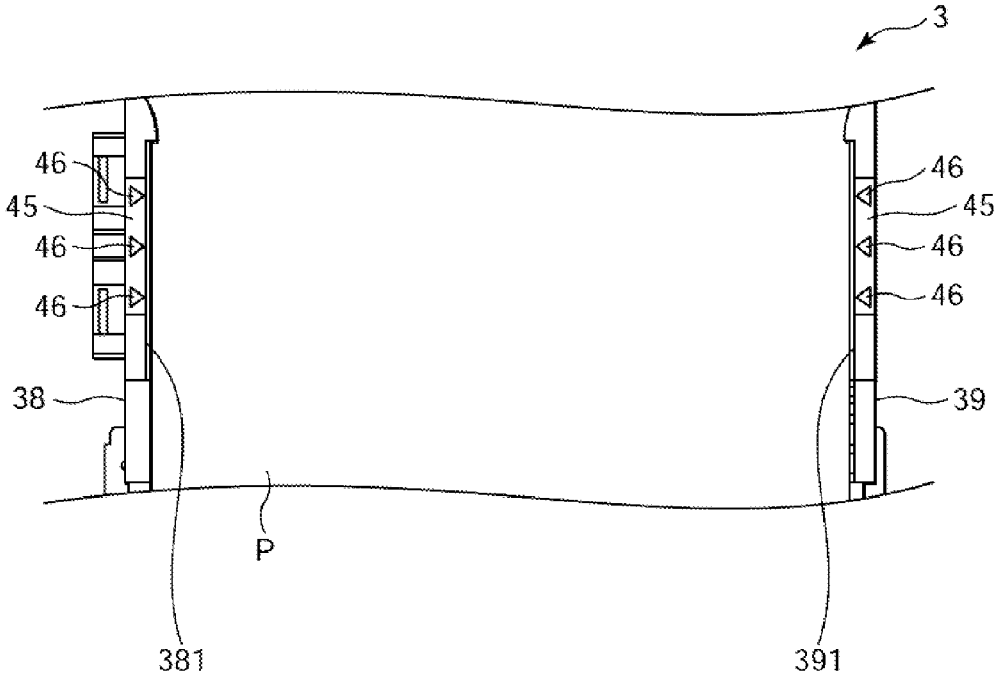
FIG. 11 is an explanatory plan view illustrating the sheet storage cassette in a state corresponding to the maximum storage capacity load according to the second embodiment.

A planar part 45 that extends along the width direction of the sheet P can be arranged on an upper side of the left restriction guide 38. Also, as shown in FIG. 11 that will be described later, the planar part 45 can be arranged on an upper side of a right restriction guide 39. The planar parts 45 can be formed horizontally on the left and right restriction guides 38 and 39 so as to collectively form a single member as the respective restriction guides. A mark 46 serving as indication of the maximum storing capacity level of the sheets P can be arranged on the planar part 45. The mark 46 can be a graphic, e.g., a triangle formed on the planar part 45, and indicate a boundary position of the maximum storing level of the sheets P. A height h from the sheet supporting board 31 to the planar part 45 can be a maximum storing height of the sheets P. The mark 46 disposed on the restriction guides 38 and 39 can be placed at the same maximum storing height h. By the described composition, the operator can confirm (e.g. see or refer to) the mark 46 that indicates the maximum storing capacity level of the sheets P from the upper side of the sheet storage cassette 3 by a visual inspection.

Figure 10:
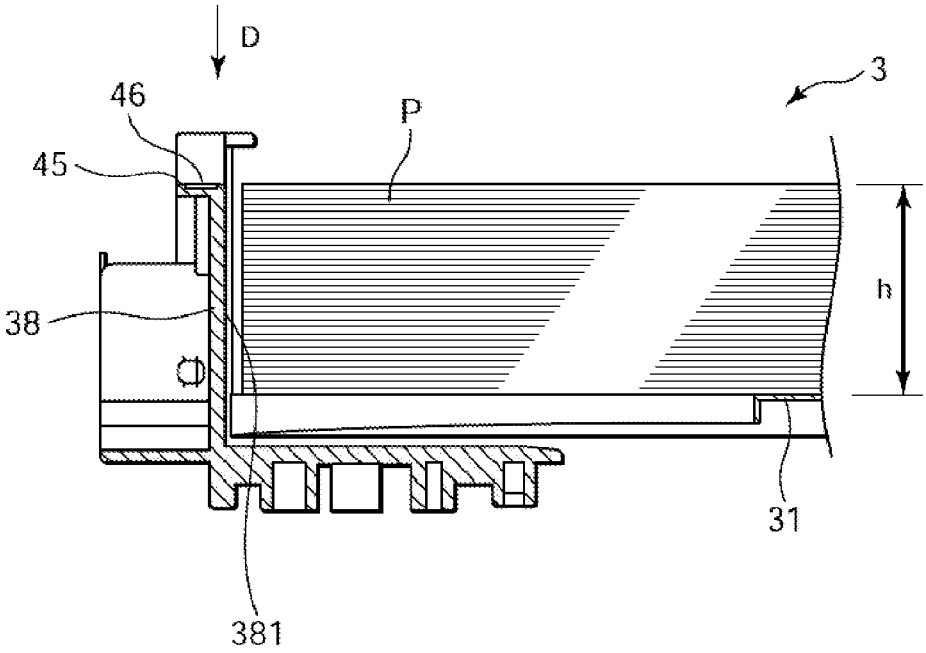
FIG. 10 is an explanatory cross-sectional view illustrating the sheet storage cassette loaded to a maximum storage capacity level according to the second embodiment.

FIG. 10 is an explanatory cross-sectional view illustrating the sheet storage cassette loaded to a maximum storage capacity level according to the second embodiment. FIG. 11 is an explanatory plan view illustrating the sheet storage cassette in a state corresponding to the maximum storage capacity load according to the second embodiment. Restriction faces 381 and 391 can be disposed laterally, e.g., on sides of the left and right restriction guides 38 and 39 so as to each face a side of a stored sheet P. The restriction faces 381 and 391 can act as sheet holding surfaces, extending in a substantially perpendicular direction with respect to the sheet supporting board 31, and holding (e.g., restricting or retaining) sheets P along sides of the sheets P. If the sheets P are stored in or on the sheet storage cassette 3, the restriction guides 38 and 39 can restrict movement of the sheets P along the width direction of the sheets P, and the front end stopper 34 and the back end guide 32 can restrict movement of the sheets P in the carrying direction of the sheets P. If the operator sets (e.g., stacks or loads) the sheets P up to the maximum capacity level on the sheet supporting board 31, the operator can load the sheets P based on the mark 46 arranged on the left restriction guide 38 or the right restriction guide 39 so that the height of the sheets P reaches to the maximum storing height h. As shown in FIG. 11, even if the sheets P are stored in or on the sheet storage cassette 3 up to the maximum capacity level, the operator can confirm (e.g., see or refer to) the marks 46 from the upper side of the sheet storage cassette 3 (in the D direction as shown FIG. 10).

Figure 12:
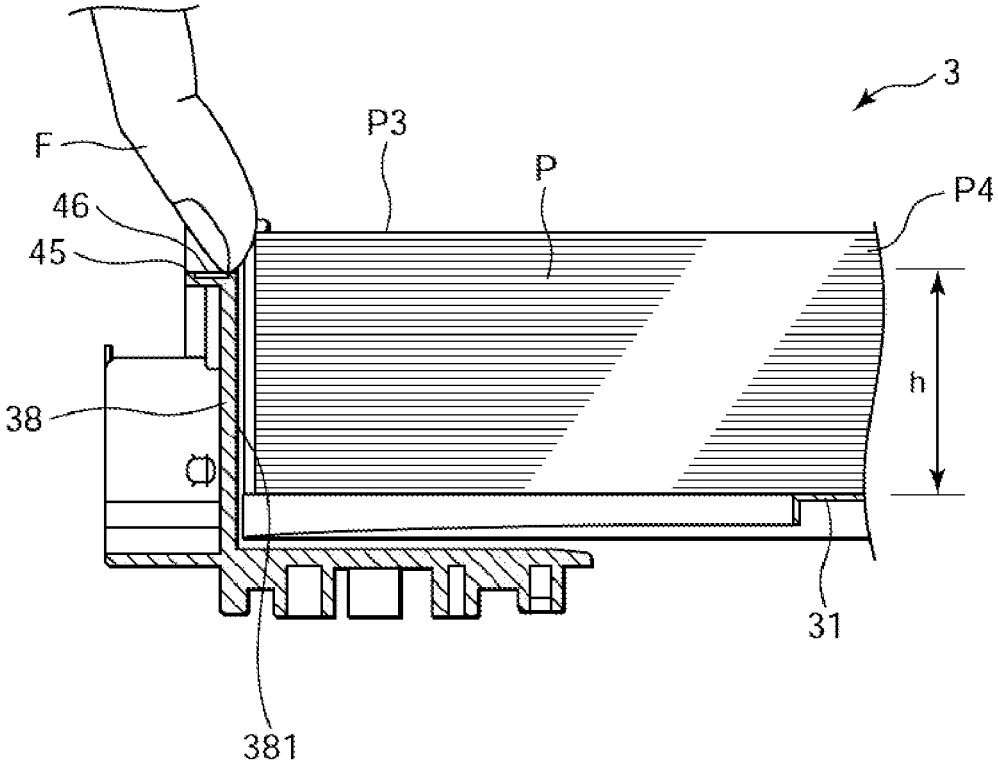
FIG. 12 is an explanatory cross-sectional view illustrating the sheet storage cassette loaded beyond the maximum storage capacity level according to the second embodiment.

FIG. 12 is an explanatory cross-sectional view illustrating the sheet storage cassette loaded beyond the maximum storage capacity level. The operator can confirm (e.g., determine) a difference in height between the mark 46 and a highest sheet P3 in the sheets P by a visual inspection. Also, the operator can insert, e.g., the finger F into a clearance gap between the inclined part 45 and the sheets P, and can confirm tactually whether or not the sheet P3 is higher than the mark 46.

If the sheet P3 is higher than the mark 46, the operator can easily remove excess sheets P4, where the excess sheets P4 can correspond to a portion of the sheets P that extend beyond the maximum storing height h. The operator can remove the excess sheets P4, for example, by inserting the finger F into the clearance gap between the mark 46 and the sheet P. In the second embodiment, the mark 46 can be a graphic, e.g., a triangle, formed on the planar part 45. However, the mark 46 is not limited to this graphic. Additionally or alternatively, for example, a hole formed on the planar part 45 can be used as the mark 46.

As described above, in the second embodiment, the planar part 45 that extends along the width direction of the sheet P can be arranged on the upper sides of the left restriction guide 38 and the right restriction guide 39, and the mark 46 that indicates the maximum storing capacity level of the sheet P can be arranged on the planar part 45 so that the operator can confirm (e.g., see or refer to) the mark 46 from the upper side of the sheet storage cassette 3. As a result, the operator can confirm the mark 46 even if the sheets P are stored in or on the sheet storage cassette 3, and can accurately set (e.g., load or stack) the sheets P to the level of the maximum storing capacity height h. Additionally, since the planar part 45 can be arranged on the left and right restriction guides 18 and 19 so as to extend along the width direction of the sheets P, the operator can confirm the difference in height between the under top edge part 37 and a highest sheet P3, and can easily remove sheets P4 that exceed the maximum storing height h. The operator can remove the excess sheets P4, for example, by inserting the finger F into the clearance gap between the inclined part 35 and the sheet P.

The above-described embodiments relate to an image forming apparatus that directly transfers the toner image onto the sheet by using a process unit. However, the embodiments are not limited in this respect. Additionally or alternatively, the described and other embodiments can be applied to an apparatus that executes image processing onto a carried sheet, such as a color image forming apparatus that uses an intermediate transfer belt, a multi color image forming apparatus that uses a number of the process units, a copy machine that includes the color image forming apparatus or the multi color image forming apparatus, and an automatic manuscript reading apparatus.

What has been described above includes examples of embodiments represented by the appended claims. It is, of course, not possible to describe every conceivable combination of components or methodologies encompassed by the claims, but it should be understood that many further combinations and permutations are possible. Accordingly, the claims are intended to embrace all such combinations, permutations, alterations, modifications and variations that fall within the spirit and scope of the claims. Moreover, the above description, and the Abstract, are not intended to be exhaustive or to limit the spirit and scope of the claims to the precise forms disclosed.

What is claimed is:

1. A sheet storage cassette, comprising:

a movable restriction guide arranged on a base of the sheet storage cassette, and configured to restrict a position of at least one sheet on the sheet storage cassette, wherein the restriction guide includes a first plane and a second plane that is formed so as to be substantially parallel to the first plane, and so as to have difference in level with respect to the first plane, and the first plane includes a mark indicating a level of a maximum storage capacity of the sheet storage cassette;

wherein the first plane and the second plane are substantially parallel to the base, and the first plane is closer to the base than is the second plane.

2. The storage cassette of claim 1, wherein the restriction guide further includes a third plane that is substantially perpendicular to the base, and the first plane and the second plane are connected to the third plane at an upper part of the third plane.

3. The storage cassette of claim 1, wherein the mark includes a triangular recess.

4. An image forming apparatus, comprising:

the sheet storage cassette according to claim 1.

* * * * *